US007300252B2

(12) United States Patent
Liang

(10) Patent No.: US 7,300,252 B2
(45) Date of Patent: Nov. 27, 2007

(54) GAS TURBINE AIRFOIL LEADING EDGE COOLING CONSTRUCTION

(75) Inventor: George Liang, Palm City, FL (US)

(73) Assignee: Alstom Technology Ltd, Baden (CH)

( * ) Notice: Subject to any disclaimer, the term of this patent is extended or adjusted under 35 U.S.C. 154(b) by 126 days.

(21) Appl. No.: 10/956,096

(22) Filed: Oct. 4, 2004

(65) Prior Publication Data

US 2006/0073016 A1 Apr. 6, 2006

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS 4,684,323 A * 8/1987 Field ..... 416/97 R
4,738,588 A * 4/1988 Field ..... 416/97 R
5,779,437 A * 7/1998 Abdel-Messeh et al. .. 416/97 R
6,183,199 B1 * 2/2001 Beeck et al. ..... 416/97 R

FOREIGN PATENT DOCUMENTS

EP 0 924 384 A2 6/1999

* cited by examiner

*Primary Examiner*—Richard A. Edgar
(74) *Attorney, Agent, or Firm*—Buchanan Ingersoll & Rooney PC

(57) ABSTRACT

A gas turbine airfoil with a pressure sidewall (6) and a suction sidewall (7) extends from a root (2) to a tip (3) and from a leading edge (4) to a trailing edge (5). It comprises several film cooling holes with exit ports (8). The film cooling holes have a sidewall that is diffused in the direction of the tip (3) of the airfoil (1) at least over a part of the film cooling hole. Furthermore, the film cooling holes each have flare-like contour near the outer surface of the leading edge (4). The film cooling holes according to the invention provide an improved film cooling effectiveness due to reduced formation of vortices and decreased penetration depth of the cooling air film.

6 Claims, 5 Drawing Sheets

GAS TURBINE AIRFOIL LEADING EDGE COOLING CONSTRUCTION

FIELD OF INVENTION

This invention pertains to a gas turbine airfoil and in particular to a cooling construction for its leading edge.

BACKGROUND ART

Airfoils of gas turbines, turbine rotor blades and stator vanes, require extensive cooling in order to keep the metal temperature below a certain allowable level and prevent damage due to overheating. Typically such airfoils are designed with hollow spaces and a plurality of passages and cavities for cooling fluid to flow through. The cooling fluid is typically air bled from the compressor having a higher pressure and lower temperature compared to the gas traveling through the turbine. The higher pressure forces the air through the cavities and passages as it transports the heat away from the airfoil walls. The cooling construction further comprises film cooling holes leading from the hollow spaces within the airfoil to the external surfaces of the leading and trailing edge as well as to the suction and pressure sidewalls.

In the state of the art the film cooling holes extending from cooling passages within the airfoil to the leading edge are positioned at a large angle to the leading edge surface and designed with a small length to diameter ratio. Typically, the angle between the cooling hole axis and the leading edge surface is greater than 20° and the ratio of the cooling hole length to the cooling hole diameter is about 10, typically less than 15. Such holes are drilled by a electro-discharge machining process and more recently by a laser drilling process. While such film cooling holes provide a good convective cooling of the leading edge of the airfoil due to the cumulative convective cooling area of all the film cooling holes together that are positioned between the root and the tip of the airfoil leading edge. The cooling air that exits the film cooling holes provides further cooling by means of a film that passes along the surface of the airfoil leading edge.

The establishment of a cooling film by means of a number of exit holes along the leading edge is sensitive to the pressure difference across the exit holes. While a small pressure difference can result in an ingestion of hot gas into the film cooling hole, a large pressure difference can result in the cooling air to blow out of the hole and will not re-attach to the surface of the airfoil.

Furthermore, the short length to diameter ratio of the film cooling holes and the large angle between the hole axes and the leading edge surface can lead to the formation of vortices about the exit holes. This results in a high penetration of the cooling film away from the surface of the airfoil and in a decrease of the film cooling effectiveness about the leading edge of the airfoil.

One way to provide better film cooling of the airfoil surface is to orient the film cooling holes at a shallower angle with respect to the leading edge surface. This would decrease the tendency of vortex formation. However, a more shallow angle results in a larger length to diameter ratio of the film cooling hole, which exceeds the capabilities of today's laser drilling machines.

European Patent EP 0 924 384 discloses an airfoil with a cooling construction of the leading edge of an airfoil that provides improved film cooling of the surface. The disclosed airfoil comprises a trench that extends along the leading edge and from the root to the tip of the airfoil. The apertures of the film cooling holes are positioned within this trench in a continuous straight row. The cooling air bleeds to both sides of these apertures and provides a uniform cooling film downstream and to both sides of the airfoil.

SUMMARY OF INVENTION

It is the object of this invention to provide an airfoil for a gas turbine with a cooling construction for its leading edge that creates an improved film cooling of the airfoil surface compared to film cooling constructions of the state of the art by means of lowering the cooling air penetration depth and cooling air distribution in both the suction and pressure side as well as spanwise direction.

According to the invention a gas turbine airfoil comprises a pressure sidewall and suction sidewall that extend from the root to the tip and from the trailing edge to the leading edge of the turbine airfoil. Within the airfoil several cooling passages are provided for cooling air to pass through and cool the airfoil from within. One or several of cooling passages are positioned along the leading edge of the airfoil. Several film cooling holes extend from these internal cooling passages along the leading edge to exit ports at the outer surface of the leading edge. Specifically, the sidewall comprises film cooling holes that are diffused in the direction of the airfoil tip at least over a part of the length of the film cooling hole. Furthermore, the film cooling holes comprise a flare or flare-like contour in the region about the outer surface of the leading edge. The flare or flare-like contour is formed over part of the opening of the film cooling hole, directed either toward the suction sidewall or toward the pressure sidewall, or it is formed over the entire opening of the film cooling hole being directed toward both the pressure and suction sidewalls of the airfoil.

The diffusion over at least a portion of the film cooling hole results in a shallower angle between the diffused sidewall and the outer surface of the leading edge. This results in a reduction of the formation of vortices as the cooling airflow experiences a smaller change in direction as it bleeds onto the airfoil surface. The diffusion also increases the breakout length and the area of the exit port of the film cooling hole, which causes a reduction of the cooling air flow velocity. This effects a smaller penetration depth of the cooling air film into the boundary layer at the airfoil surface and thus effects an increase of the film cooling effectiveness. It further also effects an improved cooling air distribution in both the suction side and pressure side direction as well as in the spanwise direction.

Although the film cooling holes according to the invention have a greater breakout length they still have an angle between their axes and the outer surface of the leading edge that is as large as in cooling constructions of the state of the art. As such they have a ratio of length to diameter that is in a suitable range for the manufacture by means of laser drilling.

Furthermore, as the angle between film cooling hole axis and the outer surface of the leading edge is large, the same number of film cooling holes can be positioned along the span of the airfoil as in the state of the art. The resulting total convection area of the film cooling holes is thus maintained, and the metal temperature of the airfoil leading edge is sufficiently cooled from within by convection. The larger breakout distance of the exit ports of the film cooling holes results in an increase of the so-called film coverage. The film coverage is expressed as the ratio between breakout distance of an exit port and the distance between axes of the film cooling holes in the plane of the exit ports. An increase in film coverage results in a further increase in film cooling effectiveness.

The flares of the film cooling holes in the region of the outer surface of the leading edge further provide a smooth flow out of the film cooling holes onto the airfoil surface and further improve the cooling effectiveness.

In a particular embodiment of the invention the film cooling comprises a first portion of cylindrical shape that extends from the internal cooling passage within the airfoil and along the leading edge into a part of the film cooling hole. This portion is intended to meter the cooling air flow. A second portion of the film cooling hole has the sidewall that is diffused in the direction of the tip of the airfoil and extends from the first portion to the exit port of the film cooling hole.

In a variant of the invention the film cooling holes have a sidewall that is diffused in the direction of the tip of the airfoil over the entire length of the film cooling hole.

In a preferred embodiment of the invention the sidewall of each film cooling hole that is closer to the tip of the airfoil has a diffusion angle with respect to the film cooling hole axis that is in the range of 3 to 7°, and preferably about 5°. Furthermore, the angle between the film cooling hole axis and the outer surface of the leading edge is in the range of 25 to 45°, preferably about 25°.

In a further particular embodiment of the invention the airfoil the film cooling holes at the leading edge are arranged in one or more rows along the span of the airfoil. The flare of the film cooling holes of the row closest to the pressure sidewall is directed toward the pressure side, and the film cooling holes of the row closest to the suction sidewall is directed toward the suction side. Finally, the flare of the film cooling holes of a center row is directed toward the pressure and suction side of the airfoil.

In a further preferred embodiment of the invention several rows of film cooling holes are positioned in a so-called showerhead arrangement along the span of the airfoil leading edge. The film cooling holes of one row are staggered with respect to the film cooling holes of a neighboring row.

The staggered showerhead arrangement provides a more uniform film distribution than an inline showerhead arrangement. It effects a better temperature distribution and lower spanwise thermal gradient. Furthermore, it provides a better structural integrity for the airfoil leading edge.

In a further embodiment of the invention the angles formed by the axes of the film cooling holes of one row and the axes of the film cooling holes of a neighboring row increase with the distance from the root to the tip of the airfoil. The airfoil leading edge diameter decreases from the root to the tip of the airfoil. In order to maintain a constant surface distance between film rows, the angle between film rows has to increase. The advantage of this cooling design approach is in that it retains a uniform showerhead film effectiveness in the film row lateral distance and thus produces a uniform airfoil leading edge metal temperature.

DETAILED DESCRIPTION OF THE INVENTION

Figure 1:
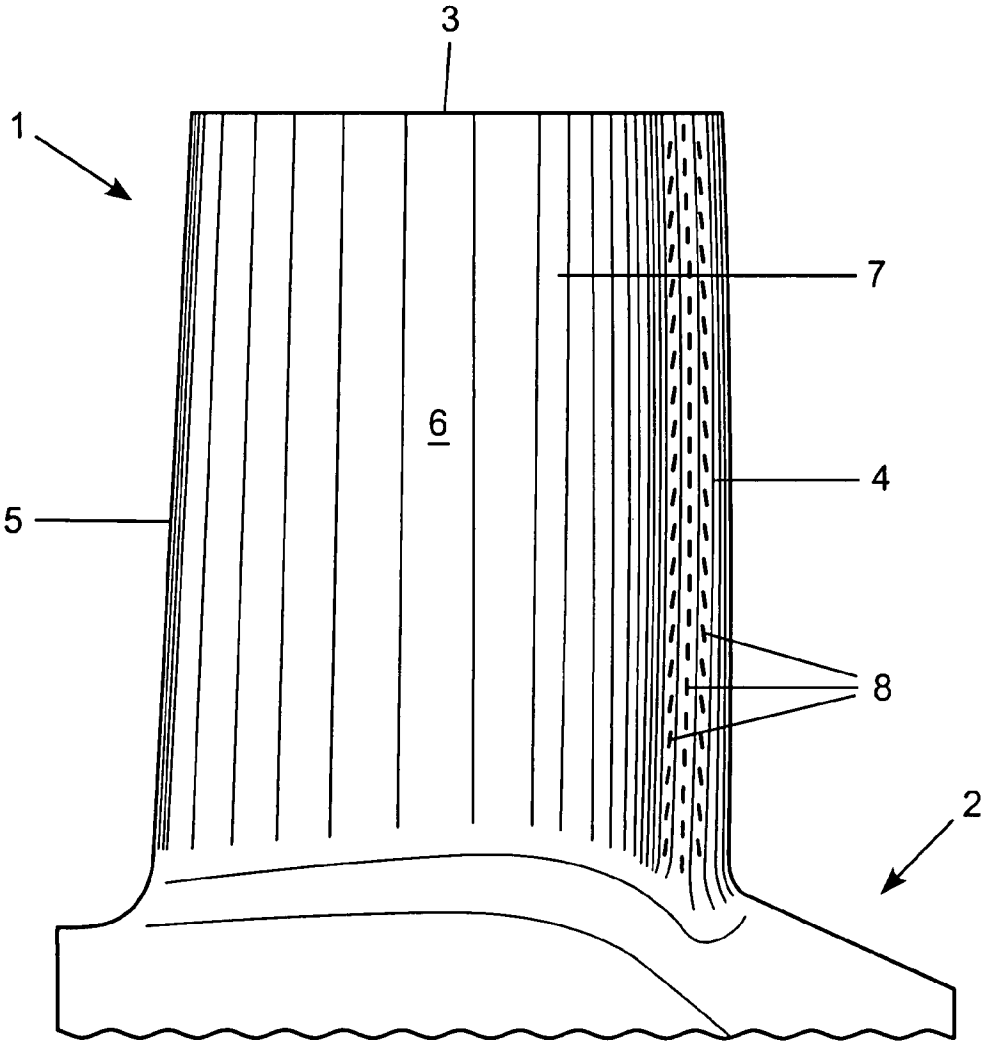
FIG. 1 shows a view of a gas turbine airfoil according to the invention with several rows of film cooling holes on its leading edge.

FIG. 1 shows a gas turbine airfoil 1 extending from a root 2 to a tip 3 and comprising a leading edge 4 and a trailing edge 5. Enclosed by a pressure sidewall 6 and a suction sidewall 7 are several passages for cooling air to pass through that has been bled from a cooling air source such as a compressor. The cooling air passing through these passages convectively cools the gas turbine airfoil, which protects the airfoil metal from overheating. Additional cooling is necessary in the region of the leading edge 4 of the airfoil. It is realized by means of film cooling holes leading from the internal cooling air passages to the outer surface of the airfoil where the cooling air flows along the airfoil surface in the manner of a film. This invention and the figures described here pertain particularly to the leading edge. The airfoil comprises multiple film cooling holes positioned along the leading edge between its root 2 and tip 3. Exit ports 8 of the film cooling holes are arranged in three rows extending from the root to the tip. The cooling air that flowing out of the exit ports streams along the outer surface of the leading edge on both the pressure sidewall 6 and suction sidewall 7 of the airfoil.

Figure 2:
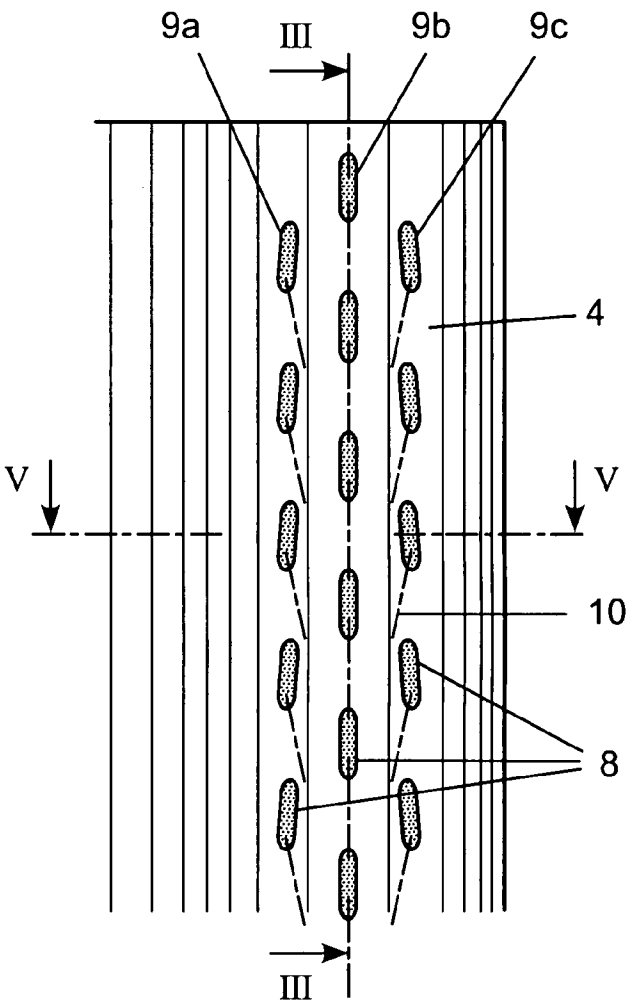
FIG. 2 shows a closer view of the film cooling holes in the showerhead arrangement.

FIG. 2 shows an excerpt of the leading edge 4 of the gas turbine airfoil 1. The exit ports 8 of the center row **9*b* are positioned at the outermost point of the leading edge 4; those of the row 9*c* are positioned on the suction side of the edge, and those of row 9*a* on the pressure side of the leading edge. The broken lines indicate the axes 10 of each film cooling hole. The end point of each axis in the plane of the exit ports is below the center of the exit port indicating that the film cooling holes are not symmetrical about their axes. The exit ports 8 of the individual row 9*a-c*** are staggered and positioned in the so-called showerhead arrangement.

Figure 3:
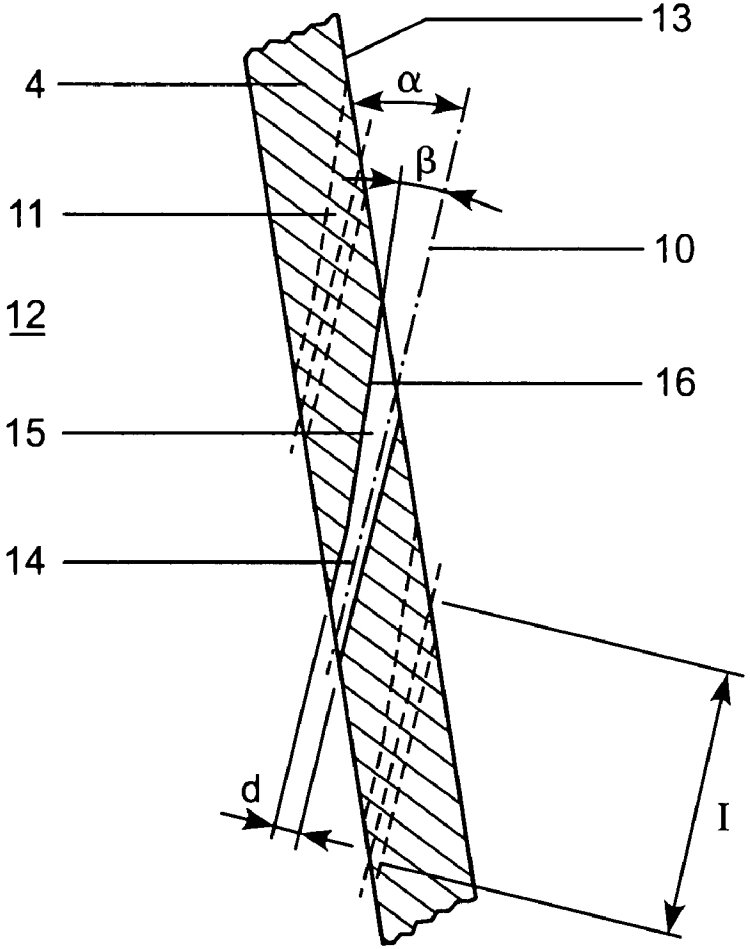
FIG. 3 shows a cross-section of the airfoil leading edge along the line III-III and the diffusion of the film cooling holes toward the tip of the airfoil.

FIG. 3 shows a cross-section of the leading edge 4 of the airfoil 1 along the line III-III. It shows the film cooling holes 11 leading from an internal cooling passage 12 within the airfoil to the outer surface 13 of the leading edge 4. The axis 10 forms an angle $\alpha$ with the outer surface 13 of the leading edge that is in the range of 25 to 45° and preferably about 25°. This allows a ratio of the film cooling hole length l to the film cooling hole diameter d of l/d in the range of less than 15. The film cooling hole 11 comprises a first portion 14 of cylindrical shape extending from the internal cooling passage 12 toward the outer surface. It further comprises a diffused portion 15 extending from the end of the first portion to the exit port 8 of the film cooling hole.

The diffused portion 15 is intended to reduce the negative effects of a large angle at the exit port between film cooling hole and leading edge surface, onto which the cooling air is to flow. The diffused portion 15 of each film cooling hole 11 is formed by the diffusion of the sidewall 16 that is closest to the tip of the airfoil with respect to the hole axis. This sidewall 16 forms an angle β with the hole axis 10 that is in the range of 3 to 7° and preferably about 5°. The exit angle between the sidewall 16 and the outer surface 13 of the leading edge is thus reduced to about 20°. The cooling air exiting from the film cooling holes then experiences a smaller change in direction and also has a reduced velocity due to the larger exit port area. It then forms fewer and smaller vortices and the sub-boundary layer formed by the cooling air film flowing along the airfoil surface is thinner. Both of these characteristics provide a greater film cooling effectiveness.

Figure 4:
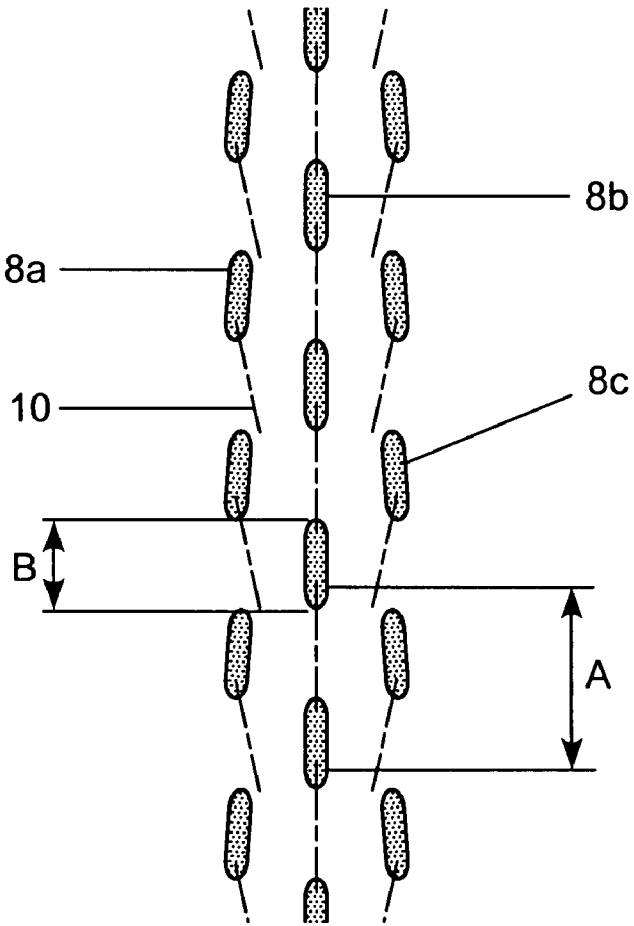
FIG. 4 shows the apertures of the film cooling holes with the dimensions demonstrating the improved film coverage.

FIG. 4 shows the same excerpt view of the exit ports as in FIG. 2. It illustrates the dimensions of the film hole surface pitch A between the neighboring exit ports and the film hole breakout length B of the exit ports 8 in the spanwise direction. The film hole surface pitch A is defined as the airfoil height divided by the number of film holes in the center row 9*b*. The film hole breakout length is preferably in the range of half of the airfoil height divided by the number of film holes in the center row 9*b*. The resulting so-called film coverage, which here is defined by the ratio of B/A, is in the range of 50%.

Airfoils of the state of the art typically have cooling constructions where the film cooling-holes are not diffused. The film coverage is smaller due to the smaller exit port length. The resulting film coverage in the state of the art is typically in the range of 30%. Hence, the cooling construction according to this invention provides further improved film cooling due to its increased film coverage.

Figure 5:
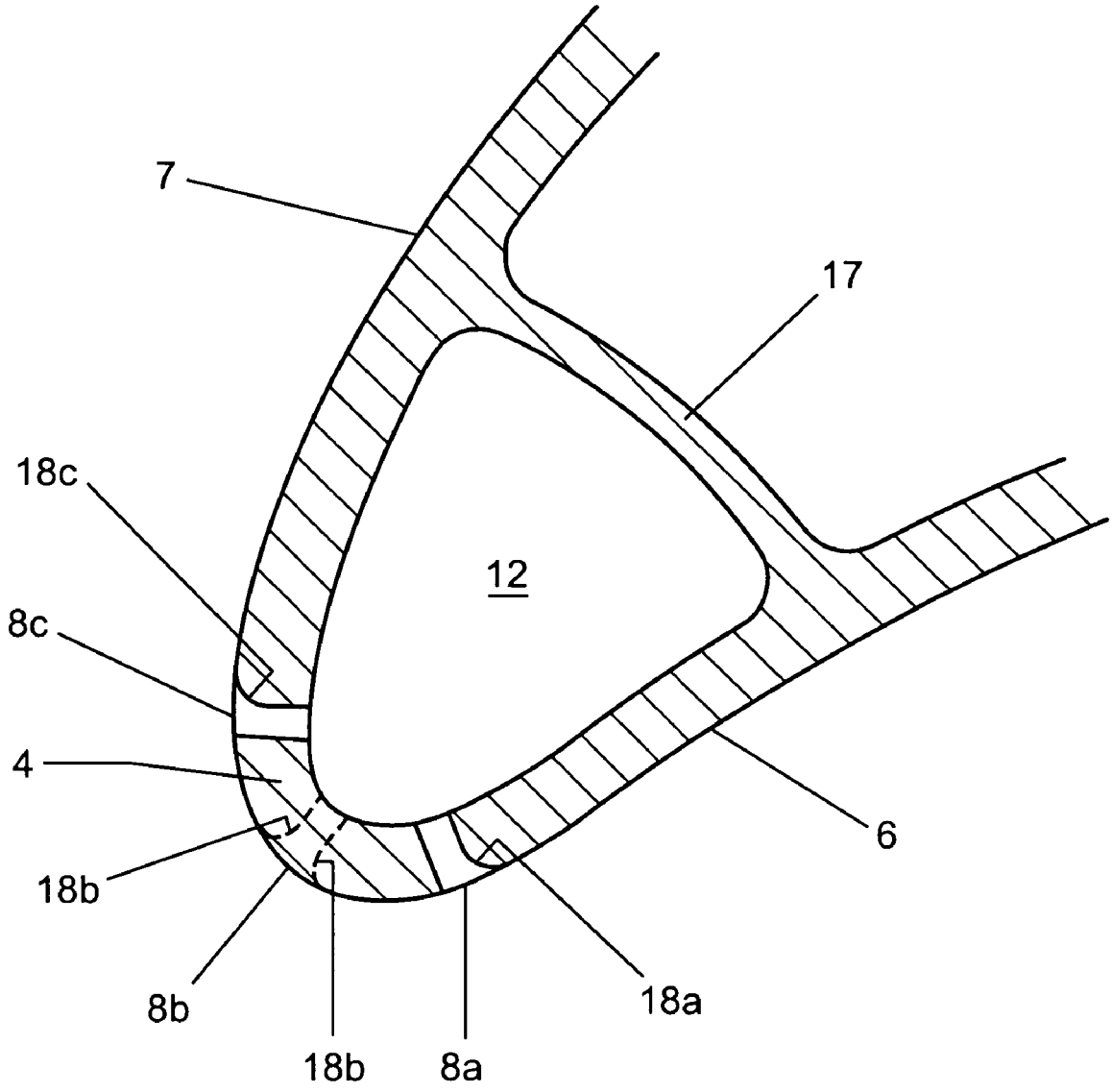
FIG. 5 shows a cross-section of the airfoil leading edge along the lines V-V with the apertures of the film cooling holes having flared edges.

FIG. 5 shows a cross-section of the airfoil leading edge along the lines V-V. The pressure sidewall 6, the suction sidewall 7, and a dividing wall 17 define an internal passage 12 that extends spanwise along the leading edge of the airfoil. Exit port 8*a* is part of the row 9*a* on the pressure side of the leading edge, exit port 8*b* is part of the row 9*b* of the film cooling holes at the point of the leading edge, and exit port 8*c* is part of row 9*c* of the film cooling holes on the suction side of the leading edge. The figure shows in particular the flares of the film cooling holes at their exit ports. The exit port 8*a* has a flare 18*a* on one side directed toward the pressure side of the airfoil. Exit port 8*b* has a flare 18*b* directed toward both the pressure and suction side and exit port 8*c* has a flare 18*c* on one side directed toward the suction side of the airfoil. The flares serve to further reduce the tendency of vortex formation in the direction of the pressure and suction sides and thus further improve the film cooling effectiveness.

Figure 6:
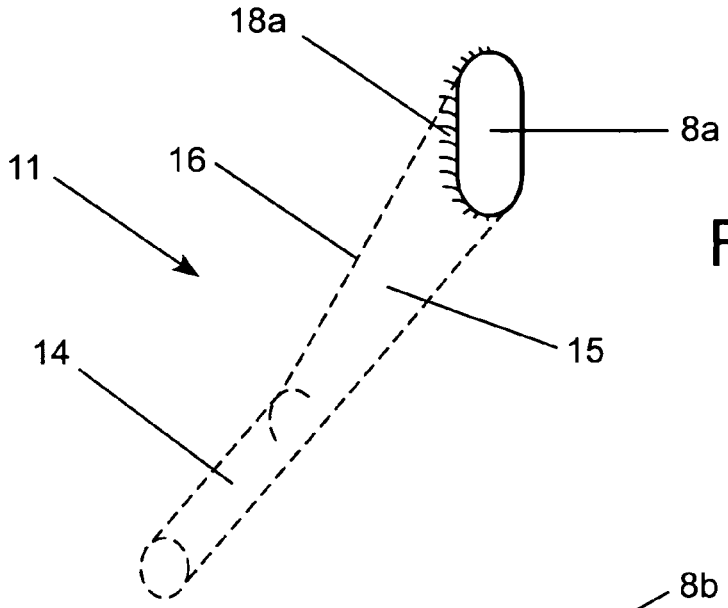
FIGS. 6-8 show for a better understanding of the invention a perspective view of the flared and diffused film cooling holes in a showerhead arrangement, FIGS. 9-11 each show a cross-section of the airfoil leading edge along the lines V-V at the level of the tip of the airfoil (FIG. 9), at mid-level between tip and root of the airfoil (FIG. 10), and at the level of the root of the airfoil (FIG. 11). They demonstrate the relative direction of the axes of the film cooling holes of the several rows.
Figure 7:
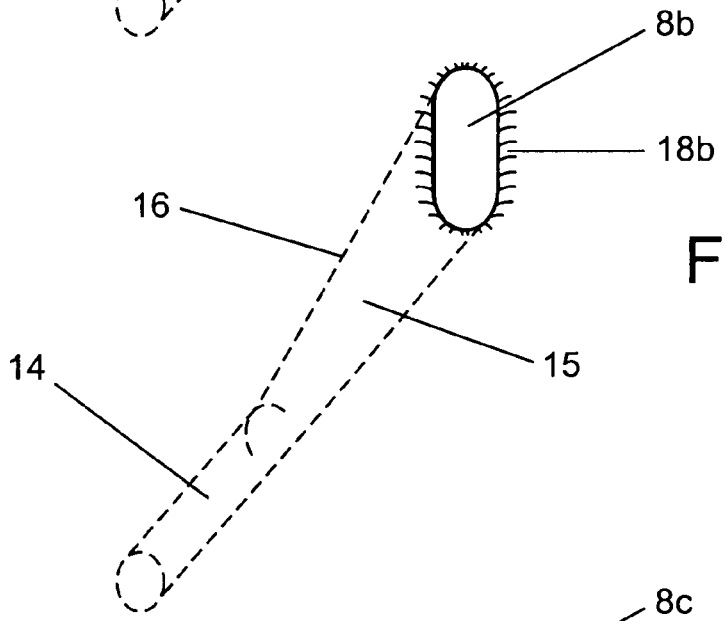
Figure 8:
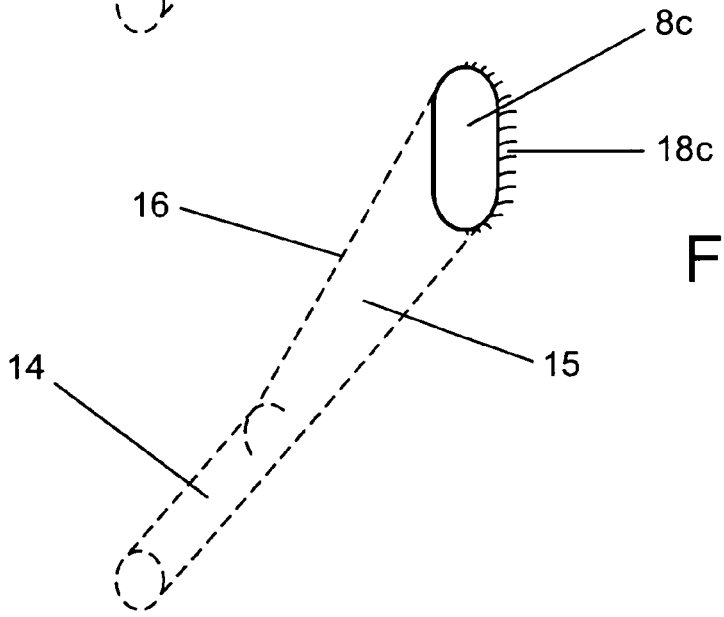

FIGS. 6-8 show for the purposes of better understanding a perspective view of the film cooling holes in a staggered arrangement. It shows the first cylindrical portions 14, the diffused second portions 15, and the flares 18*a,b,c* directed toward the pressure side, to both pressure and suction side of the airfoil, and toward the suction side, respectively.

Figure 9:
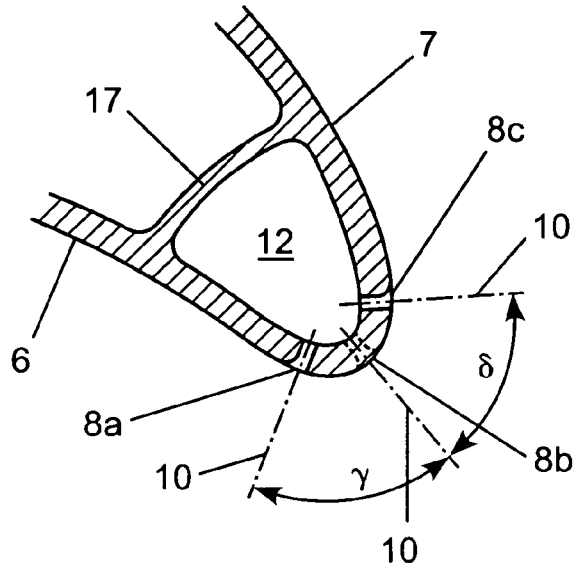
Figure 10:
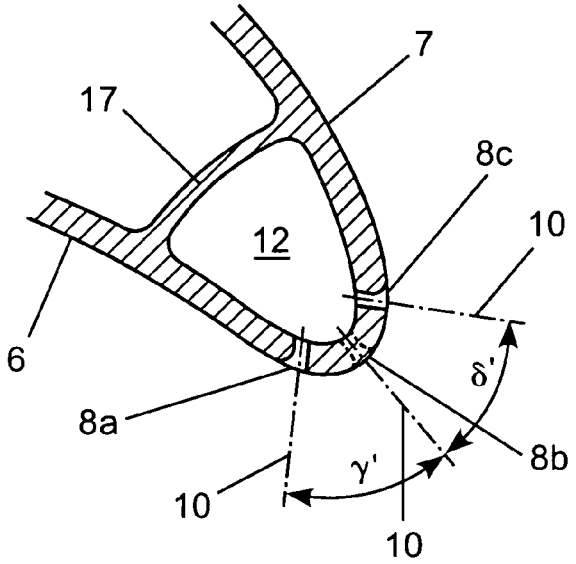
Figure 11:
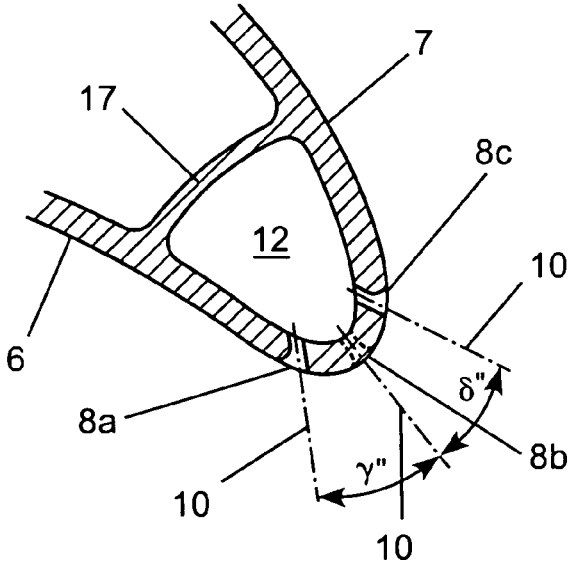

FIGS. 9-11 each show a cross-section of the leading edge along lines V-V. FIG. 9 is a taken at the level of the tip of the airfoil, FIG. 10 at mid-level between the root and the tip, and FIG. 11 at the level of the root of the airfoil. The figures show the orientation of the film cooling holes of one row relative to the orientation of the film cooling holes of the neighboring row in the plane of the cross-section. The axis 10 of a film cooling hole 8*a* on the pressure side forms an angle γ with the axis 10 of film cooling hole 8*b* near the tip of the airfoil, and an angle γ' at mid-level between root and tip, and an angle γ" at the level of the root of the airfoil.

Respectively, the angle between the axis 10 of the film cooling hole 8*b* at the point of the leading edge and the axis 10 of the film cooling hole 8*c* on the suction side is δ, δ', and δ" at the three levels of the airfoil.

The angles between the film cooling hole axes 10 increase with the distance from the root to the tip of the airfoil. The angles γ, γ', and γ" are preferably in the range between 40° and 25° and the angles δ, δ', and δ" are in the range between 38° and 26°.

As the thickness of the airfoil decreases from the root toward the tip the size of the angles between film cooling holes increases. As mentioned earlier, this retains a uniform showerhead film effectiveness and produces a uniform airfoil leading edge metal temperature.

TERMS USED IN THE FIGURES

1 gas turbine airfoil
2 root of the airfoil
3 tip of the airfoil
4 leading edge
5 trailing edge
6 pressure sidewall
7 suction sidewall
8*a,b,c* exit ports of film cooling holes at leading edge
9*a,b,c* rows of exit ports of film cooling holes
10 axes of film cooling holes
11 film cooling hole
12 internal passage within airfoil
13 outer surface of leading edge
14 first portion of film cooling hole of cylindrical shape
15 second portion of film cooling hole, diffused shape
16 film cooling hole sidewall
17 dividing wall within airfoil
18*a,b,c* flares
α angle between axis of film cooling hole and outer surface of leading edge
β angle between axis of film cooling hole and diffused sidewall
γ, γ', γ" angle between axes of film cooling holes of neighboring rows
δ, δ', δ" angle between axes of film cooling holes of neighboring rows
d diameter of film cooling hole
l length of film cooling hole
A film cooling hole surface pitch in a given row
B film cooling hole breakout length in spanwise direction

The invention claimed is:

1. Gas turbine airfoil with a pressure sidewall and a suction sidewall, extending from a root to a tip and from a leading edge to a trailing edge and comprising several cooling passages between the pressure sidewall and the suction sidewall for cooling air to pass through and cool the airfoil from within, and where one or several of the cooling passages extend along the leading edge of the airfoil and several film cooling holes extend from the internal cooling passages along the leading edge to the outer surface of the leading edge;

wherein the film cooling holes extending through the leading edge of the airfoil each have a sidewall that is diffused in the direction of the tip of the airfoil at least over a part of the length of the film cooling hole and that the film cooling holes each have a curved flare at the outer surface of the leading edge where the flare is directed toward the suction sidewall, or toward the pressure sidewall, or toward both the pressure sidewall and the suction sidewall of the airfoil; and wherein the film cooling holes each comprise a first portion and a second portion where the first portion has a cylindrical shape and extends from the internal cooling passage along the leading edge of the airfoil partially into the leading edge and the second portion extends from the first portion to the outer surface of the leading edge, and where the second portion has a sidewall closest to the tip of the airfoil that is diffused in the direction of the tip;

wherein the sidewall of the film cooling hole diffused toward the tip of the airfoil forms a diffusion angle with the film cooling hole axis that is in the range of 3 to 7° and the axis of the film cooling holes form an angle with the outer surface of the leading edge that is in the range of 25° to 45°.

2. Gas turbine airfoil according to claim 1, wherein the diffusion angle is about 5°, and the angle of the film cooling holes with the outer surface of the leading edge is about 25°.

3. Gas turbine airfoil with a pressure sidewall and a suction sidewall, extending from a root to a tip and from a leading edge to a trailing edge and comprising several cooling passages between the pressure sidewall and the suction sidewall for cooling air to pass through and cool the airfoil from within, and where one or several of the cooling passages extend along the leading edge of the airfoil and several film cooling holes extend from the internal cooling passages along the leading edge to the outer surface of the leading edge wherein the film cooling holes extending through the leading edge of the airfoil each have a sidewall that is diffused in the direction of the tip of the airfoil at least over a part of the length of the film cooling hole and that the film cooling holes each have a flare at the outer surface of the leading edge where the flare is directed toward the suction sidewall, or toward the pressure sidewall, or toward both the pressure sidewall and the suction sidewall of the airfoil; and wherein the film cooling holes at the leading are arranged in three or more rows extending from the root to the tip of the airfoil and that the flare of the film cooling holes in the one or more center rows is directed to both the pressure sidewall and the suction sidewall and the flare of the film cooling holes of the row closest to the pressure sidewall is directed to the pressure sidewall and the flare of the film cooling holes of the row closest to the suction sidewall is directed toward the suction sidewall.

4. Gas turbine airfoil according to claim 3 wherein the film cooling holes of one row are staggered with respect to the film cooling holes of a neighboring row.

5. Gas turbine airfoil according to claim 4 wherein the angle formed by the axes of the film cooling holes of one row and the axes of the film cooling holes of a neighboring row increases with distance from the root to the tip of the airfoil.

6. Gas turbine airfoil according to claim 5 wherein the sum of the film cooling hole breakout lengths in the center film row is greater than 30% and less than 60% of the airfoil height, preferably about 50% of the airfoil height.

* * * * *